United States Patent [19]

Seibel et al.

[11] 4,289,232

[45] Sep. 15, 1981

[54] DIAPHRAGM CASE OR THE LIKE

[75] Inventors: Paula Seibel, 307 W. 105th St., Apt. 4B, New York, N.Y. 10025; Wayne J. Stettler, Philadelphia, Pa.

[73] Assignee: Paula Seibel, New York, N.Y.

[21] Appl. No.: 50,343

[22] Filed: Jun. 20, 1979

[51] Int. Cl.[3] ..... A45C 11/00; B65D 85/16

[52] U.S. Cl. ..... 206/37; 206/69; 206/38; 132/79 F

[58] Field of Search ..... 206/37, 38, 69, 438; 132/79 F, 80 R, 79 R; 128/127; 220/DIG. 26

[56] References Cited

U.S. PATENT DOCUMENTS

| | | | |
|---|---|---|---|
| 818,412 | 4/1906 | Byrne | 132/79 F |
| 1,726,143 | 8/1929 | Eisinger | 206/69 |
| 2,035,356 | 3/1936 | White et al. | 220/DIG. 26 |
| 2,366,009 | 12/1944 | De Pasquale et al. | 206/37 |
| 3,371,664 | 3/1968 | Pleshette | 128/127 |

*Primary Examiner*—William T. Dixson, Jr.
*Attorney, Agent, or Firm*—Darby & Darby

[57] ABSTRACT

A diaphragm case comprises top and bottom portions, approximately circular in shape and hinged together at a point on the circumference. An internal container, integrally molded with the bottom, is adapted to contain a contraceptive cream or jelly and is closed by a cover which forms an airtight enclosure. The top and bottom portions are closed by a latching arrangement which is integrally formed with the respective portions and which is not airtight.

1 Claim, 4 Drawing Figures

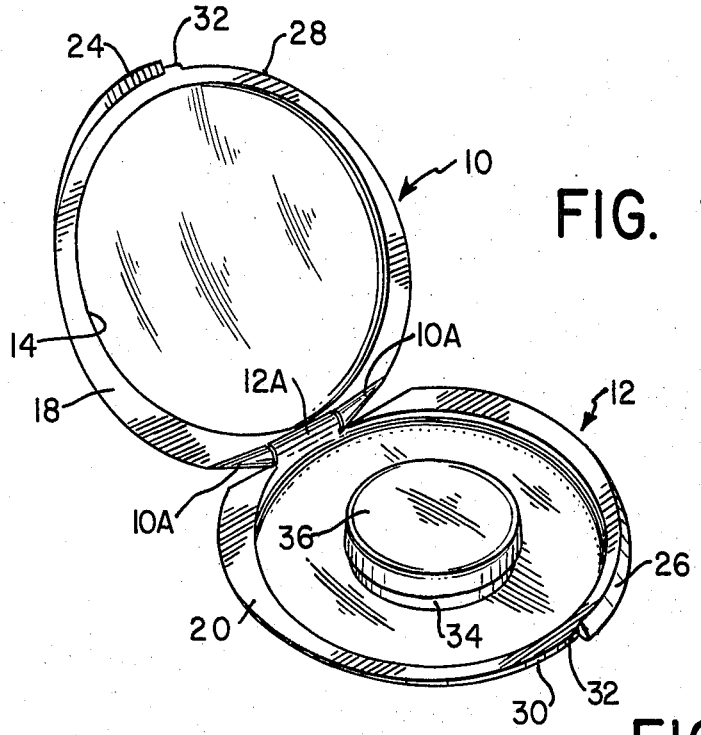
FIG. 1
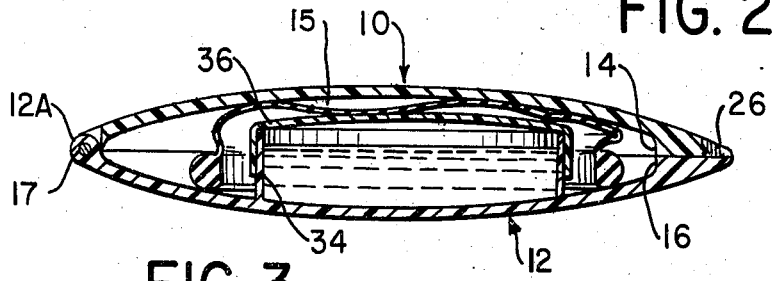
FIG. 2
FIG. 3
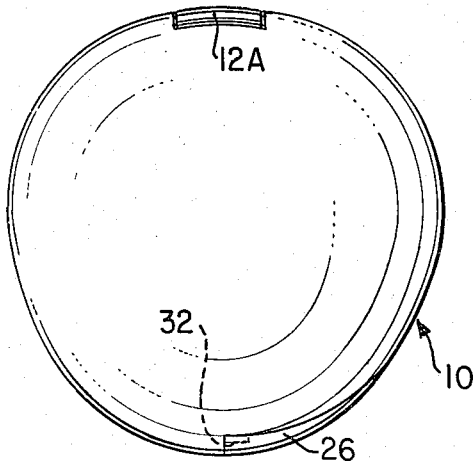
FIG. 4
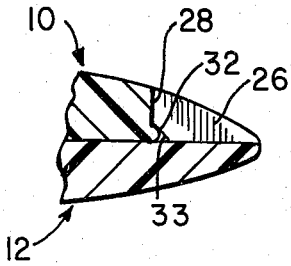

DIAPHRAGM CASE OR THE LIKE

This invention relates to a cosmetic/pharamceutical type device. More particularly, this invention relates to a carrying case for use with contraceptive diaphragms.

There are various types of diaphragm cases which can be used to carry a diaphragm of the type used for contracptive purposes. Commercially available diaphragm cases include no provisions for containing the contraceptive cream or jelly which should be used at the time of insertion of the diaphragm. This requires that the user not only carry the diaphragm case but she must also have with her a tube of contraceptive ointment which of oftentimes inconvenient.

The object of this invention is to provide a diaphragm case, which is attractive in appearance and which includes a special container within which a contraceptive cream or jelly can be carried in an airtight enclosure.

THE DRAWINGS

FIG. 1 is a prospective view of a diaphragm case according to the invention, in an open position;

FIG. 2 is a side sectional view of the diaphragm case of FIG. 1;

FIG. 3 is a plan view of the invention; and

FIG. 4 is a close-up sectional view of the closure mechanism of the diaphragm case.

DETAILED DESCRIPTION

In accordance with the invention, a diaphragm case comprises a top half 10 and a bottom half 12. The top and bottom 10 and 12 are preferably molded of a high-quality plastic and include circular openings 14 and 16, respectively, in which a contraceptive diaphragm 15 can be conveniently nested. They are pivotally attached together by a pin 17 extending through integrally formed top and bottom hubs 10A and 12A, respectively.

The top and bottom halves 10 and 12 when closed resemble somewhat a shell or the like. The top 10 includes an annular upper ledge 18 which engages a complementary annular lower ledge 20 on the bottom 12. The two halves 10 and 12 also include vertically displaced curved sections 24 and 26 which are generally triangular in cross-section and which may conveniently be grasped by the user to open the case. The sections 24 and 26 are offset in such a way that they mate closely with the outer portion of the opposite halves 10 and 12, respectively. Thus, when the case is closed, the lower surface of the top section 24 completes the bottom surface of the case and the upper surface of the bottom section 26 completes the top surface of the case.

The upper and lower halves 10 and 12 include peripheral rims 28 and 30 which face directly the displaced sections 26 and 24, respectively, when the case is closed. The rim 28 may include a small projections 32 which engages a small depression 33 in the interior wall of the section 26 so as to lock the top and bottom 10 and 12 together in a closed position.

In accordance with the invention, a generally cylindrical wall 34 extends upwardly from the central portion of the interior bottom half 12. The user may place a small amount of a contraceptive cream or jelly within the interior container formed by this cylindrical wall 34. This interior container is closed by a cap 36 pressed or screwed onto the container wall to provide an airtight enclosure. If desired, the interior container may include a layer of inert material (e.g. zinc) to preclude any possible reaction with the ointment to be stored therein.

I claim:

1. A diaphragm case, comprising:

top and bottom closure halves, each said half having the approximate external shape of a shell and including:

(a) an internal circular depression (b) a flat ledge around said depression, with the flat ledges of the two sections adapted to engage each other when the case is closed, (c) a vertically displaced section shaped to conform generally to the edge of a shell at the front of each closure half, each of said displaced sections forming in conjunction with the opposite closure half a shell like construction when closed, and (d) a locking projection on the flat ledge adapted to snap engage a complementary depression in the vertically displaced section of the other half, an integrally formed container extending upwardly from the center of the bottom section and adapted to hold a contraceptive ointment, air-tight closure means for said container, means for pivotally securing said half sections together, said means being positioned opposite said vertically displaced sections, a contraceptive ointment in said container, and a flexible diaphragm within said case and enveloping said container.

* * * * *